US006291809B1

(12) United States Patent
Ha

(10) Patent No.: US 6,291,809 B1
(45) Date of Patent: Sep. 18, 2001

(54) WALL-MOUNTED MICROWAVE OVEN

(75) Inventor: Jae-ki Ha, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/810,537

(22) Filed: Mar. 19, 2001

(30) Foreign Application Priority Data

Oct. 5, 2000 (KR) ..... 00-58579
Feb. 27, 2001 (KR) ..... 01-10128

(51) Int. Cl.[7] ..... H05B 6/68

(52) U.S. Cl. ..... 219/757; 219/702; 219/716; 126/21 A; 126/273 A; 126/299 D

(58) Field of Search ..... 219/757, 756, 219/702, 715, 716; 126/21 A, 299 R, 299 D, 273 A, 273.5, 275 E

(56) References Cited

U.S. PATENT DOCUMENTS 5,232,402 * 8/1993 Lorenzon ..... 454/222
5,951,907 * 9/1999 Kang ..... 219/757
5,981,929 * 11/1999 Maeda et al. ..... 219/757
6,072,169 * 6/2000 Kang et al. ..... 219/702

* cited by examiner

*Primary Examiner*—Philip H. Leung
(74) *Attorney, Agent, or Firm*—Robert E. Bushnell, Esq.

(57) ABSTRACT

Disclosed is a wall-mounted type microwave oven including a main body having a suction grill for an air passageway to a cavity, a hood duct for a second air passageway for fumes and smoke generated from a gas range placed below the microwave oven, a hood inlet port and outlet port coupled to the hood duct, a hood fan installed within the hood duct of the main body, and discharging air drawn in through the suction port and the hood inlet port, through the hood outlet port, a louver opening and closing the suction grill, a louver driving motor driving the suction louver, a hood switch turning on over a predetermined temperature, and activating the hood fan, and a hood driving circuit part activating the louver driving motor so as to open the louver depending upon a turn-on state of the hood switch.

20 Claims, 4 Drawing Sheets

WALL-MOUNTED MICROWAVE OVEN

CLAIM OF PRIORITY

This application makes reference to, incorporates the same herein, and claims all benefits accruing 35 U.S.C. §119 from an application for Wall Mounted Type Microwave Oven earlier filed in the Korean Industrial Property Office on Oct. 5, 2000 and there duly assigned Serial No. 58579/2000 and an application for Microwave Oven earlier filed in the Korean Industrial Property Office on Feb. 27, 2001 and there duly assigned Serial No. 10128/2001 by that Office respectively.

BACKGROUND OF THE INVENTION

1. Field of Invention

The present invention relates present invention relates to a wall-mounted microwave oven, and more particularly, to a wall-mounted microwave oven capable of opening and closing a louver in response to a hood switch.

2. Description of the Related Art

A microwave oven mounted above a gas oven or range includes two air ducts, such as a cavity duct for supplying outside air into a cavity, in which food to be cooked is placed, and a hood duct for providing a passageway of fumes and smoke generated from the gas range and passing through the microwave oven. Generally, a hood motor mounted in the hood duct draws the fumes and smoke into the hood duct and exhaust the fumes and smoke outside the hood duct of the microwave oven. Since the cavity duct is communicated with the hood duct, a vacuum state occurred inside the microwave oven causes the hood motor to be overloaded if the cavity duct is closed during the operation of the hood motor.

FIG. 1 illustrates a conventional wall-mounted microwave oven including a main body 3 having a rectangular cooking cavity 4 in which food to be cooked in placed, an outer case 6 enclosing main body 3, a door 7 opening and closing cooking cavity 4, and a control panel 5 controlling a cooking condition of the food. Over the door 7 and the control panel 5 are horizontally installed an elongated suction grill 27 along main body 3.

Outer case 6 includes an upper case 6*a* covering a top and sides of main body 3, and a lower case 6*b* coupled to a bottom of main body 3. Between upper case 6*a* and the top side of the main body 3 is formed a space providing an air passage of outside air drawn into cooking cavity 4 through elongated suction grill 27. A duct member 14 is installed at a rear portion of suction grill 27 within the space for guiding a flow of air drawn in through the suction grill 27. Within a space between either side of upper case 6*a* and main body 3 is formed a hood duct for providing a passage of moisture and fumes generated from the gas range mounted below the microwave oven and passing through the main body of the microwave wave.

Lower case 6*b* has a hood inlet port 8 for drawing the moisture and fumes into hood duct 15. A hood outlet port 9 for discharging the moisture and fumes drawn into hood duct 15 is formed on a top surface of upper case 6*a*. A hood fan 13 is installed on main body 3 adjacent to hood outlet port 9 of upper case 6*a*. While hood fan 13 operates, the moisture and fumes drawn into hood duct 15 through hood inlet port 8 are discharged outside through hood outlet port 9. A hood switch is installed within hood duct 15 and turns on when the inner temperature of hood duct 15 is higher than a predetermined temperature. The hood switch is usually formed with a thermostat using a bimetal, and hood fan 13 starts to operate when the hood switch turns on. The suction grill 27 includes a rectangular grill frame 26 installed in front of main body 3, a louver 25 rotatably installed at the front of grill frame 26 covering an opening of rectangular grill frame 26, and a louver driving device 20 for driving louver 25.

When the gas range operates, hot air containing the fumes and moisture spreads around hood duct 15 through hood inlet port 8, and the hood switch turns on when the internal temperature of hood duct 15 is higher than a predetermined temperature so as to allow hood fan 13 to operate automatically. When hood fan 13 operates, a control unit controls louver driving means 20 to rotate louver 25 for opening suction grill 27.

When the control unit does not operate in a normal manner, the operation of hood fan 13 cannot be detected by the control unit even if the inner temperature of hood duct 15 increases and if hood fan 13 starts to operate. Accordingly, louver 25 does not rotate to open suction grill 27, and the air is not drawn in through suction grill 27. Therefore, the space in which the duct member 14 is installed is vacuumized depending on the operation of hood fan 13, thereby overloading hood fan 13.

SUMMARY OF THE INVENTION

It is an object of the present invention to provide an improved wall-mounted microwave oven capable of opening and closing a louver depending upon an operation of a hood switch irrespective of a normal operation of a control unit controlling the louver.

It is another object to provide a wall-mounted microwave oven able to prevent an overload of a hood motor exhausting air contained in a hood duct by automatically opening a louver of a suction grill communicated with the hood duct.

It is also object to provide a wall-mounted microwave oven able to avoid a vacuum state inside the wall-mounted microwave oven by opening a louver covering a suction grill during operating of a hood motor exhausting air contained in a hood duct communicated with the suction grill.

These and other objects of the present invention may be achieved by a wall-mounted type microwave oven including a main body having a suction grill formed on a front side of the main body, a hood inlet port and a hood outlet port both coupled to a hood duct, a hood fan installed within the hood duct of the main body and discharging air drawn through the suction port and the hood inlet port outside the microwave oven through the hood outlet port, a louver opening and closing the suction grill, a louver driving motor driving the suction louver, a hood switch turned on over a predetermined temperature and supplying a power to the hood fan, and a hood driving circuit part supplying the power to the louver driving motor so as to open the louver, depending upon a turn-on state of the hood switch.

The louver driving circuit part includes a louver relay switch switching on and off the louver driving motor, a hood switching part coupled to the louver relay switch so that the louver relay switch is activated when the hood switch turns on, and first and second switching parts coupled between the louver relay switch and the hood switching part and activating the louver relay switch depending on opening and closing states of the louver so that the louver driving motor opens the louver when the suction louver is not completely opened.

The hood switching part includes a driving switch coupled to the louver relay switch and switching on and off the louver relay switch and a power supply switch supplying electric power to drive the driving switch when the hood switch turns on.

The first switching part includes a first microswitch turning on or off depending upon opening and closing states of the louver and a first transistor coupled to the louver relay switch and turned on and off depending upon the first microswitch while the second switching part includes a second microswitch connected in parallel to the first microswitch to the louver relay switch through a second transistor.

BRIEF DESCRIPTION OF THE DRAWINGS

A more complete application of this invention, and many of the attendant advantage thereof, will be readily apparent as the same becomes better understood by reference to the following detailed description when considered in conjunction with the accompanying drawing in which like reference symbols indicate the same or similar components, wherein.

DETAILED DESCRIPTION OF THE PREFERRED EMBODIMENTS

Figure 1:
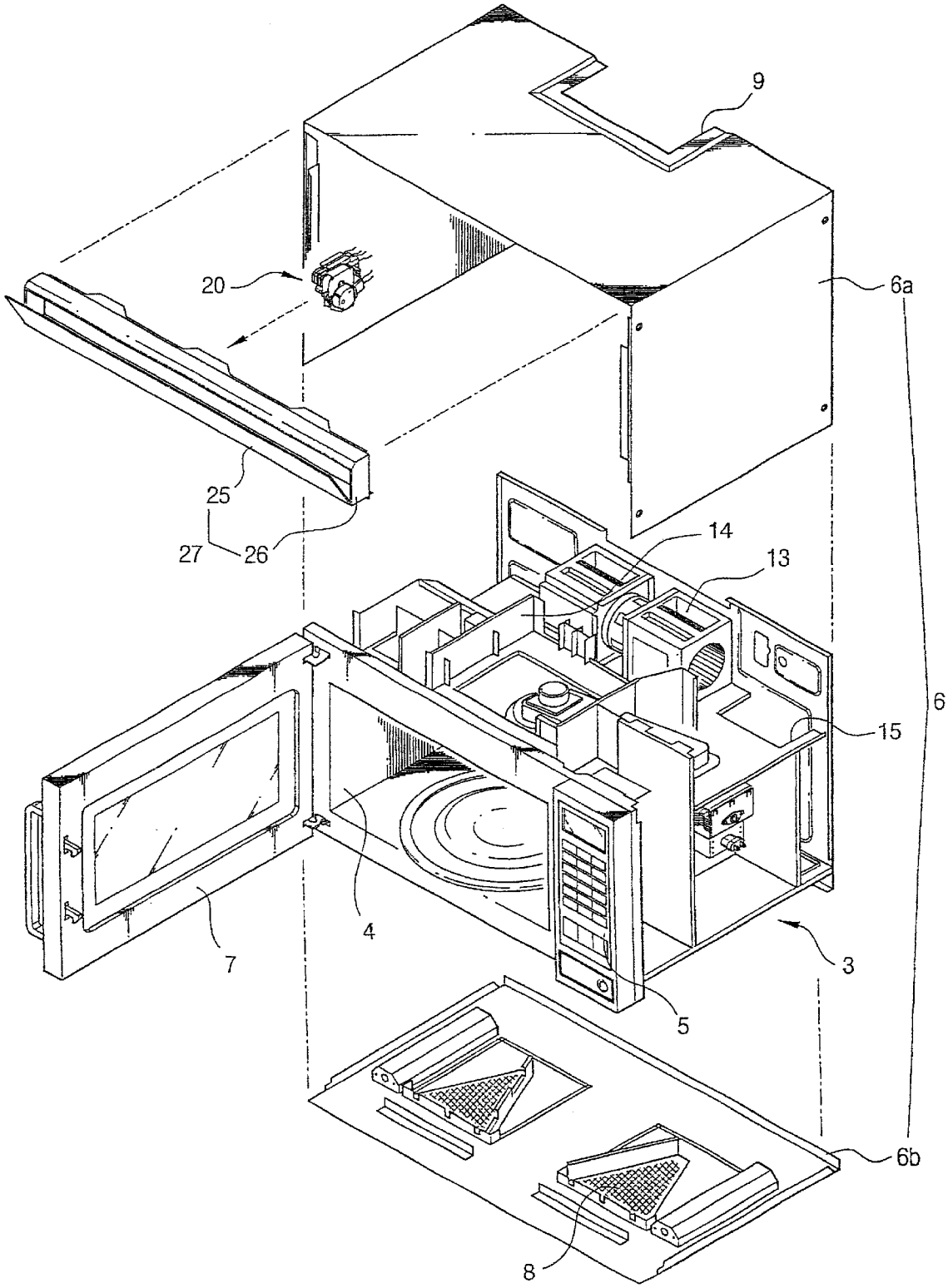
FIG. 1 is a perspective view of a conventional wall-mounted type microwave oven.
Figure 2:
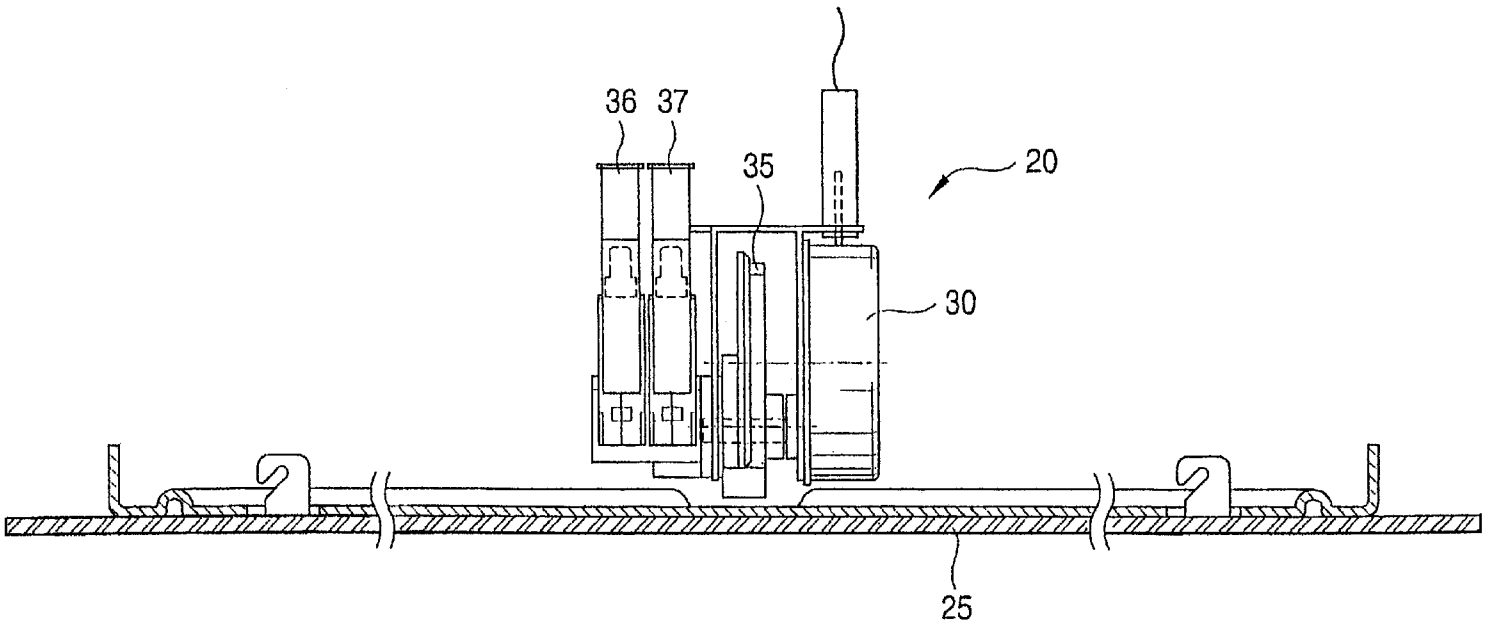
FIG. 2 is a partial sectional view of a louver mounted on a wall-mounted type microwave oven illustrated according to the present invention.

A microwave oven according to the present invention has the same mechanical structure as described with reference to FIG. 1. As illustrated in FIGS. 1 and 2, a suction grill 27 of the wall-mounted type microwave oven according to the present invention includes a rectangular grill frame 26 installed in front of main body 3, a louver 25 of a planar type rotatably installed at the front of grill frame 26, and a louver driving device 20 for operating louver 25.

Louver driving device 20 as shown in FIG. 2 includes a louver driving motor 30 installed adjacent to suction louver 25, a cam 35 coupled to an axle of louver driving motor 30 and being in contact with louver 25 to open and close grill frame 26, and first and second microswitches 36 and 37 installed adjacent to cam 35. First and second microswitches 36 and 37 contact or are separated from cam 35 and turn on and off depending upon the opening and closing states of louver 25 driven by cam 35.

Figure 3:
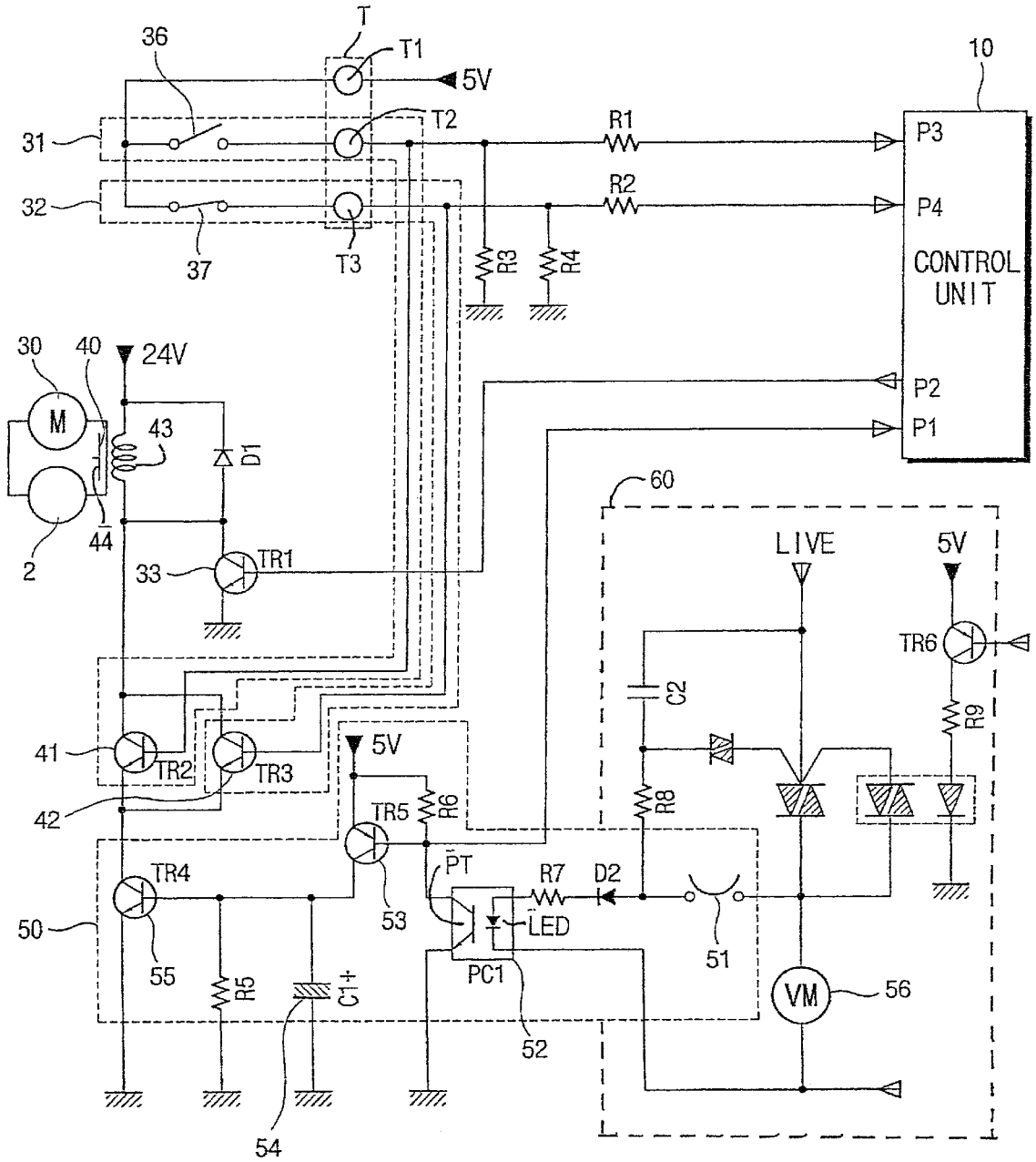
FIG. 3 is a circuit diagram controlling the louver of FIG. 2.

A driving circuit for driving louver 25 as shown in FIG. 3 includes a louver relay switch 40 connecting a power supply part 2 to louver driving motor 30 and disconnecting power supply part 2 from louver driving motor 30, a hood switching part 50 turned on and off depending upon operation of a hood switch 51 to supply electric power to louver relay switch 40, first and second switching parts 31 and 32 installed between louver relay switch 40 and hood switching part 50 and turned on and off depending upon rotation of louver 25 to supply electric power to louver relay switch 40, and a control unit 10 controlling supply of the electric power to drive louver relay switch 40 according to signals from hood switching part 50 and first and second switching parts 31 and 32.

Like a general relay switch, louver relay switch 43 has a coil 44 and a switch 42. The louver driving motor 30 is connected to one end of switch 44, and power supply part 2 is connected to the other end of switch 44. When the electric power is supplied to coil 43 of louver relay switch 40, switch 44 turns on, and electric power is supplied from power supply part 2 to louver driving motor 30 to activate louver motor 30 opening and closing louver 25.

Hood switching part 50 is coupled to a hood fan motor driver 60 and includes a photo coupler 52 connected to hood switch 51 and generating a hood switching signal when hood switch 51 turns on, a driving switch 55 connected to the louver relay switch 40 and connecting and disconnecting the electric power supplied to louver relay switch 40, and a power supply switch 53 coupled between a photo coupler 52 and driving switch 55 and turned on and off in response to the hood switching signal from photo coupler 52 to turn on and off driving switch 55. A condenser 54 and a resistor R5 are connected in parallel on a power line between power supply switch 53 and driving switch 55 and rectify driving power supplied by power supply switch 53, and the rectified power is supplied to driving switch 55. The driving switch 55 turns on by the driving power so that louver relay switch 40 operates. Power supply switch 53 is a pnp type transistor while driving switch 55 is a npn type transistor.

Hood switch 51 is connected between a light emitting diode LED of photo coupler 52, a hood fan motor 56 and hood fan motor driver 60 to drive hood fan 13 coupled to hood fan motor 56. Electric power is supplied to hood fan motor 56 depending upon turn-on of hood switch 51, and hood fan 13 starts to operate when hood switch 51 turns on.

First switching part 31 includes a first microswitch 36 coupled to a terminal T1 of a terminal board T and turned on and off depending upon an operation of cam 35 when louver 25 is opened and closed, and a first transistor 41 coupled to first microswitch 36 through a terminal T2 and turned on and off depending upon an operation of first microswitch 36. Second switching part 32 includes a first microswitch 37 coupled to a terminal T1, connected in parallel to first microswitch 36, and turned on and off depending upon an operation of the cam 35, and a second transistor 42 coupled to second microswitch 27 through a terminal T3 connected in parallel to first transistor 41 and turned on and off depending upon second microswitch 37. First and second transistors 41 and 42 are npn type transistors so that first and second transistors 41 and 42 turn on and off under the same conditions. In other words, the first and second microswitches 36 and 37 are connected to each other in parallel between terminal T1 and a power line to louver relay switch 40 and are connected in parallel on between driving switch 55 and louver relay switch 40. Thus, if either one of first or second switching parts 31 or 32 turns on, driving power is supplied to louver relay switch 40 from hood switching part 50.

Since first and second microswitches 36 and 37 turn on and off according to a rotation position of cam 35, opening and closing operation of louver 25 can be determined according to turning on and off of first and second microswitches 36 and 37. When both first and second microswitches 36 and 37 are turned off, louver 25 is opened. When first and second transistors 41 and 42 turn off, the supply of driving power to louver relay switch 40 is prevented. Where one of first and second microswitches 36 and 37 turns on and the other thereof turns off, louver 25 is closed or is in process of being opened or closed. In this case, because a power source is being supplied to either and of first or second transistors 41 or 42, the driving power is supplied to coil 43 of louver relay switch.

First microswitch 36, second microswitch 37, and abase terminal of power supply switch 53 are electrically connected to control unit 10, respectively. Control unit 10 determines whether louver 25 is in operation to be opened when hood switch 51 turns on depending upon on and off states of first and second microswitches 36 and 37 and of power supply switch 53.

A pin P3 of control unit 10 is connected to louver relay switch 40 through a louver operating switch 33 which is turned on and off according to a signal from pin P3 of control unit 10. If louver operating switch 33 turns on, louver relay switch 40 operates. Louver operating switch 33 is a npn type transistor.

In the microwave oven having this configuration, grill frame 26 is normally closed by louver 25. Where food is cooked by the microwave oven, grill frame 26 is opened. However, when food is cooked by the gan range, grill frame 26 may be opened manually when a temperature of hood duct 15 reaches a predetermined value.

When food is cooked by the gas range, hot air containing moisture and fumes is generated and enters hood duct 15 through hood inlet port 8. Hood switch 51 turns on when the internal temperature of hood duct 15 reaches a predetermined value by the hot air containing the moisture and fumes, and accordingly hood fan motor 56 and photo coupler 52 are activated.

Control unit 10 determines based on the hood switching signal from hood switch 51 whether hood switch 51 turns on or not, and detects based on microswitching signal from first and second microswitches 36 and 37 whether louver 25 is open or closed. When either one of first and second microswitches 36 and 37 turns on, control unit 10 determines that louver 25 is closed or is not completely open and supplies a louver operating signal to louver operating switch 33 to turn on louver relay switch 40, thereby opening louver 25. When both of first and second microswitches 36 and 37 turn off, control unit 10 determines that louver 25 is open and does not supply the louver operating signal to louver operating switch 33.

TABLE 1

| Louver | First microswitch | Second Microswitch |
|---|---|---|
| Open | 0 (no signal to 41) | 0 (no signal to 42) |
| During opening | 0 | 1 |
| Closed | 1 | 0 |
| During Closing | 0 | 1 |

The table 1 indicates a relationship between on and off states of first and second microswitches 36 and 27 and opening and closing states of louver 25.

In case of a normal operation, control unit 10 controls louver operating switch 33 to activate louver motor 30 depending upon on and off states of hood switch 51 and on and off states of first and second microswitch 36 and 37, to thereby controlling an opening or closing operation of louver 25.

In case of an abnormal operation, control unit 10 mechanically controls an operation of louver 25 through the following process. If hood fan motor 56 and photo coupler 52 turn on by hood switch 51, hood fan 13 is activated, and an electrical signal of photo coupler 52 is transmitted to power supply switch 53, thereby turning on power supply switch 53. If power supply switch 53 turns on, the driving power supplied through power supply switch 54 is rectified by condenser 54 and resistor R5, and n turns on driving switch 55.

If driving switch 55 turns on, louver relay switch 40 is activated depending upon opening or closing states of louver 25. When louver 25 is open, both of first and second microswitches 36 and 37 are off, no microswitching signal is transmitted to first and second transistors 41 and 42, and louver relay switch 40 is not activated. When louver 25 is closed or in process of being opened or closed, one of first and second microswitches 36 and 37 turns on, and louver relay switch 40 is activated, to open louver 25.

As described above, microwave oven according to present invention includes first and second transistors 41 and 42 being turned on and off depending upon the opening and closing states of louver 25, louver relay switch 40, and turning on and off states of driving switch 55 turned on and off by hood switch 51. When louver 25 is not open, at least one of first and second microswitches 36 and 37 is closed and turns on, thereby allowing louver relay switch 40 to be activated when hood switch 51 turns on.

Even though control unit 10 is in an abnormal operation, louver 25 can be opened if hood switch 51 turns on, and one of first and second microswitches 36 and 37 turns on. Thus, when hood switch 51 turns on, the hot air containing moisture and fumes are drawn into hood duct 15 through hood inlet port 8 and discharged outside the microwave oven through hood outlet port 9 by operation of hood fan 13 coupled to hood fan motor 56, and at same time, outside door air is drawn through suction grill 27. Thus, although control unit 10 is not under the normal operation, hood switch 51 is turned on, and hood fan 13 is activated, to thereby open suction louver 25. Accordingly, the air containing the fumes and smoke is a smoothly exhausted through hood duct 15 and the overload of hood fan motor 56 is prevented.

Figure 4:
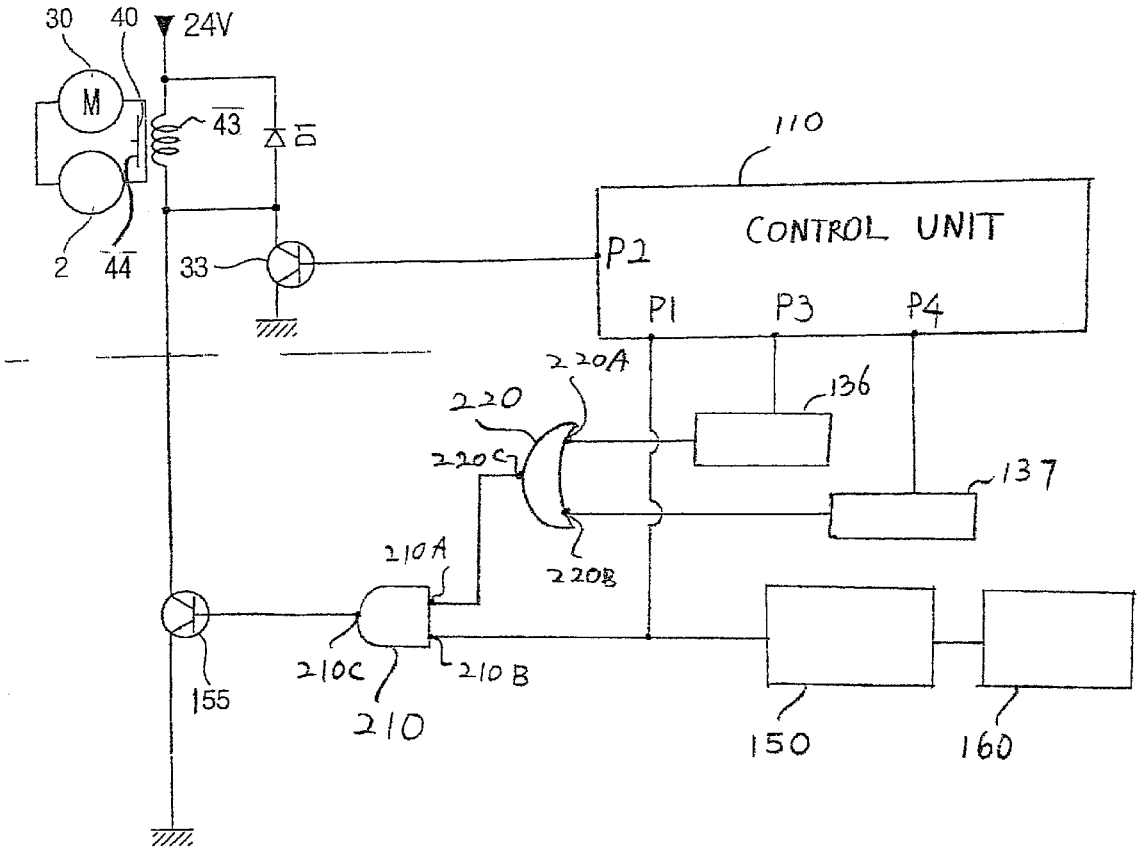
FIG. 4 is a circuit diagram of another embodiment controlling the louver according to the principle of the invention.

As shown in FIG. 4, a pin P2 of control unit 110 is coupled to a base terminal of louver operating switch 33 to activate louver relay switch 40. An output of hood switching part 150 having hood switch 51 is transmitted both pin Pin1 of control unit 110 and an input port 210B of an AND Gate 210. Hood switching part 150 is coupled to hood fan motor driver 160 controlled by both control unit 110 and a power source. First and second switching parts 136 and 137 having a first and second microswitches and, respectively, are coupled to both pin P3 of control unit 110 and one input 220A of an OR Gate 220 and both pin P4 of control unit 110 and the other input 220B or OR 13 Gate 220, respectively. An output of OR Gate 220 is coupled to the other input 210A of AND Gate 210. An output of AND Gate 210 is coupled to a base of driving switching transistor coupled to a coil 43 of louver relay switch 40. Depending on both an output of hood switching part 150 and one output of first and second switching parts 136 and 137, lover relay switch 40 is activated, and louver motor 30 operates.

As described above, according to the present invention, a louver can be opened and closed depending upon an operation of hood switch irrespective of a normal operation of control unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven, comprising:

a main body having a cavity for cooking food, a grill member connected to said cavity and forming a first air passageway, a hood duct having a hood inlet port and a hood outlet port and forming a second air passageway, a hood fan disposed on said hood duct and drawing air into said hood duct through said grill member and said hood inlet port and discharging the air outside said main body through said hood outlet port, a hood motor coupled to said hood fan, a louver mounted on said grill member and opening and closing said first air passageway, and a louver driving motor driving said louver;

a hood switch connected to said hood motor, activating said hood motor, generating a hood switching signal; and a driving circuit coupled between said louver driving motor and said hood switches, activating said louver driving motor in response to said hood switching signal.

2. The microwave oven of claim 1, further comprising:

a microswitch connected to said louver, coupled to said driving circuit, generating a microswitching signal representing the state of said louver; and said driving circuit coupled to both said hood switch and said microswitch, activating said louver driving motor in response to both said hood switching signal and said microswitching signal.

3. The microwave oven of claim 1, further comprising a switching unit directly coupled between said louver driving motor and driving circuit, connecting said driving circuit to said louver driving motor when said louver is not opened.

4. The microwave oven of claim 3, with said driving circuit comprising:

a driving switch connected to said louver driving motor, supplying electric power to said louver driving motor; and a power supply switch activating said driving switch when said hood switch turns on.

5. The microwave oven of claim 3, with said switching unit including a first switching including a first microswitch turned on and off depending upon opening and closing state of said louver and a first transistor coupled to said first microswitch and turned on and off depending upon said first microswitch, said switching unit including second switching includes a second microswitch turned on and off depending upon opening and closing state of said louver and a second transistor connected to said second microswitch.

6. The microwave oven of claim 5, with said first and second transistors coupled between said louver driving motor and said driving circuit in parallel in order to couple said driving circuit to said louver driving motor in response to one of said first and second switching units.

7. A microwave oven, comprising:

a main body having a cavity for cooking food, a grill member connected to said cavity and forming a first air passageway, a hood duct forming a second air passageway, a hood fan disposed on said hood duct, a hood motor coupled to said hood fan;

a louver mounted on said grill member and closing and opening said first air passageway;

a louver motor driving said louver;

a hood switch connected to said hood motor, activating said hood motor, generating a hood switching signal; and a driving circuit coupled between said louver motor and said hood switch, activating said louver motor in response to said hood switching signal.

8. The microwave oven of claim 7, further comprising a switching unit disposed between said driving circuit and said louver motor to couple said driving circuit to said louver motor.

9. The microwave oven of claim 8, with said switching unit comprising:

a louver switch connected to said louver, generating a louver switching signal representing one of opening and closing states of said louver; and a driver coupled to said louver switch, disposed between said driving circuit and said louver motor to couple said driving circuit to said louver motor in response to said louver switching signal.

10. The microwave oven of claim 9, with said louver motor activated to open said louver in response to both said hood switching signal and said louver switching signal.

11. The microwave oven of claim 8, said driving circuit and said switching unit coupled to said louver motor in series.

12. The microwave oven of claim 8, further comprising:

a control unit coupled to said hood switch and said first switching part, generating an operating signal in response to said hood switch and said first switching part; and an operating switch disposed between said louver motor and said control unit, activating said louver motor in response to said operating signal.

13. The microwave oven of claim 12, with said driving circuit and said operating switch coupled to said louver in parallel.

14. The microwave oven of claim 7, with said first air passageway having different and separated from said second air passageway, communicated with said second air passageway.

15. The microwave oven of claim 7, further comprising a first switching unit and a second switching unit both coupled to said driving circuit in parallel.

16. The microwave oven of claim 15, with said first switching unit and said second switching unit each comprising:

a louver switch connected to said louver, generating a louver switching signal representing one of opening and closing states of said louver; and a driver coupled to said louver switch, disposed between said driving circuit and said louver motor to couple said driving circuit to said louver motor in response to said louver switching signal.

17. The microwave oven of claim 16, with said louver motor activated to open said louver in response to both said hood switching signal and said louver switching signal generated from one of said first switching unit and said second switching unit.

18. The microwave oven of claim 16, further comprising:

a control unit coupled to said hood switch, said first louver switch unit, and said second louver switch unit, generating an operating signal in response to said hood switch and said louver switching signal from said first louver switch unit and said second louver switch unit; and an operating switch disposed between said louver motor and said control unit, activating said louver motor in response to said operating signal.

19. A method in a microwave oven, comprising the steps of:

providing a grill member forming a first air passageway and a hood duct forming a second air passageway being different and separate from said first air passageway within said microwave oven;

providing a hood motor mounted on said hood duct, a louver mounted on said grill member and opening and closing said first air passageway, and a louver motor driving said louver;

making a first determination of whether said louver is closed;

making a second determination of whether said hood motor turns on; and activating said louver motor to open said louver in response to both said first determination and said second determination.

20. The method of claim 19, comprising the steps of providing a switching unit generating a louver switching signal representing one of an opening state, a closed state, and an opening and closing process; and activating said louver motor to open said louver in response to said louver switching signal and said second determination.

* * * * *